US005664477A

United States Patent [19]

Koehler

[11] Patent Number: 5,664,477

[45] Date of Patent: Sep. 9, 1997

[54] CONTROL SYSTEM FOR A HYDRAULIC CIRCUIT

[75] Inventor: Douglas W. Koehler, Naperville, Ill.

[73] Assignee: Caterpillar Inc., Peoria, Ill.

[21] Appl. No.: 644,141

[22] Filed: May 10, 1996

[51] Int. Cl.[6] ..... F15B 13/08; F15B 20/00

[52] U.S. Cl. ..... 91/529; 91/451; 91/459; 91/461; 91/465; 91/471; 137/596.12; 137/596.16

[58] Field of Search ..... 91/451, 459, 461, 91/465, 471, 529; 137/596.12, 596.16

[56] References Cited

U.S. PATENT DOCUMENTS

| | | | |
|---|---|---|---|
| 5,138,838 | 8/1992 | Crosser | 60/433 |
| 5,350,152 | 9/1994 | Hutchison et al. | 251/30.05 |
| 5,366,202 | 11/1994 | Lunzman | 251/30.05 |
| 5,537,818 | 7/1996 | Hosseini et al. | 91/459 X |
| 5,568,759 | 10/1996 | Aardema | 91/459 X |

*Primary Examiner*—Gerald A. Michalsky
*Attorney, Agent, or Firm*—J. W. Burrows

[57] ABSTRACT

A control system is provided for use in a hydraulic system to provide a simple arrangement with a limited number of elements that bypasses the system flow in the event of an electrical malfunction in the system and further allows other hydraulic circuits to operate even if one or more of the hydraulic circuits have experienced an electrical malfunction. The subject arrangement uses an electro-hydraulic fluid flow control valve mechanism in conjunction with directional valve mechanisms that have at least three functional positions and are controlled by associated electrically controlled displacement control mechanisms in response to receipt of electrical signals from an electrical controller. In the event of an electrical malfunction, each of the directional valve mechanisms are spring biased to one of its extreme positions in the absence of an electrical signal to the associated electrically controlled displacement control mechanisms and the electro-hydraulic fluid flow control valve mechanism bypasses all of the fluid from a source of pressurized fluid to a reservoir. With the directional valve mechanisms of one hydraulic circuit in their spring biased extreme positions, the electrical signal to the electro-hydraulic fluid flow control valve mechanism can be re-instated and the other hydraulics can be operated.

8 Claims, 2 Drawing Sheets

CONTROL SYSTEM FOR A HYDRAULIC CIRCUIT

TECHNICAL FIELD

This invention relates generally to an electro-hydraulic circuit having one or more actuators and more particularly to a control system therefor having a bypass valve and a pair of control valves arranged so that each control valve controls fluid flow to and from only one port of the reversible hydraulic actuator.

BACKGROUND ART

In hydraulic systems having separate control valves for controlling flow into opposite ends or ports of an actuator or fluid motor, separate proportional valves or solenoid valves are required in order to control the position of the main flow spool. Naturally, this requires extra valves and associated lines and controls. Furthermore, in some systems, if there is an electrical malfunction or an electrical short in the system, the entire system is no longer functional. It is desirable to reduce the number of proportional or solenoid valves and their associated lines and controls and to provide a system in which if there is an electrical short or electrical malfunction in one part of the system that controls one actuator, the other actuators may still be operated in a normal manner.

The present invention is directed to overcoming one or more of the problems as set forth above.

DISCLOSURE OF THE INVENTION

In one aspect of the present invention, a control system is provided and adapted for use in a hydraulic system including a reservoir, a source of pressurized fluid connected to the reservoir, a hydraulic circuit having an actuator with first and second fluid ports, first and second directional valve mechanisms each having at least three positions and being connected between the source of pressurized fluid and the respective ones of the first and second fluid ports of the actuator, and an input controller operative to output an electrical signal to an electrical controller that is proportional to a desired input. The control system comprises an electro-hydraulic fluid flow control mechanism associated with the source of pressurized fluid and operative to control the volume of fluid being delivered from the source of pressurized fluid to the actuator. An electrically controlled displacement control mechanism is connected to each of the directional valve mechanisms and operative to move the respective directional valve mechanisms in proportion to receipt of a signal from the electrical controller that is representative of the desired input. Each of the directional valve mechanisms is spring biased to one of its extreme positions in the event of an electrical malfunction in the system.

In another aspect of the present invention, a method is provided for controlling individual hydraulic circuits in a hydraulic system in the event of an electrical malfunction in one of the hydraulic circuits. The hydraulic system includes a reservoir, a source of pressurized fluid connected to the reservoir, an electro-hydraulic fluid flow control mechanism operative to control the flow of fluid from the source of pressurized fluid to the hydraulic circuits in response to an electrical signal, at least two hydraulic circuits each having an actuator with first and second fluid ports, first and second directional valve mechanisms each having at least three positions and being controlled by respective electrically controlled displacement control mechanisms and connected between the source of pressurized fluid and the respective ones of the first and second fluid ports of the actuator, and an input controller operative to output an electrical signal to an electrical controller that is proportional to a desired input. The method comprises the steps of detecting the electrical malfunction in one of the hydraulic circuits, de-energizing the electro-hydraulic fluid flow control mechanism and the respective electrically controlled displacement control mechanisms in the one hydraulic circuit to allow the respective first and second directional valve mechanisms to return to their spring biased extreme positions and re-energizing the electro-hydraulic fluid flow control mechanism in cooperation with the operation of the other functioning circuits.

BEST MODE FOR CARRYING OUT THE INVENTION

Figure 1:
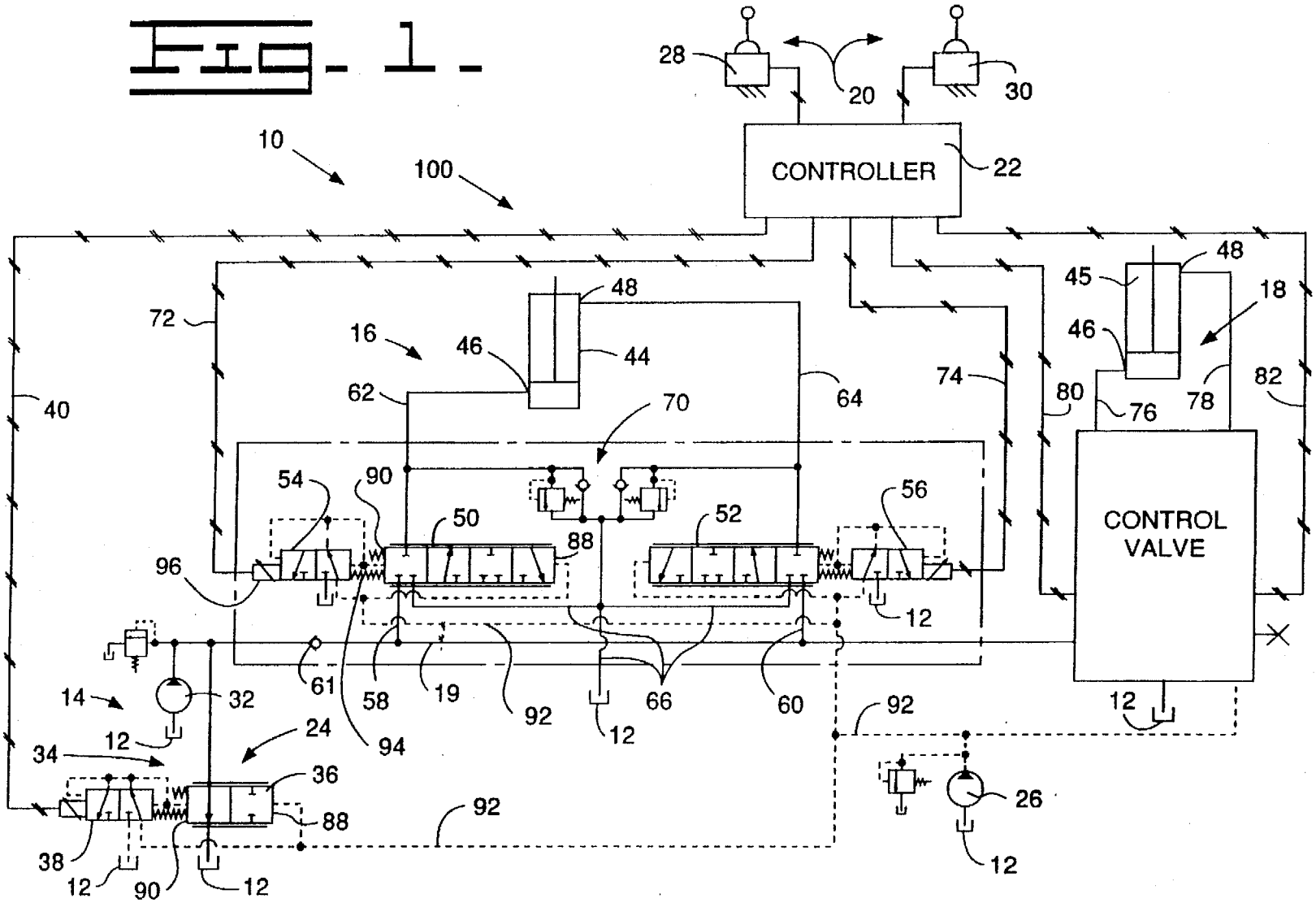
FIG. 1 is a partial diagrammatic and a partial schematic representation of a hydraulic system incorporating an embodiment of the subject invention.

Referring to FIG. 1 of the drawings, a hydraulic system 10 is illustrated and includes a reservoir 12, a source of pressurized fluid 14, first and second hydraulic circuits 16,18 connected in parallel to the source of pressurized fluid 14 by a fluid conduit 19, an input controller 20, an electrical controller, such as a microprocessor 22, connected to the input controller 20, an electro-hydraulic fluid flow control mechanism 24 and a source of pressurized pilot fluid, such as a pilot pump 26.

The input controller 20 includes first and second control lever mechanisms 28,30 that are each connected to the electrical controller 22 and operative to output an electrical signal to the electrical controller 22 proportional to a desired input from an operator.

The source of pressurized fluid 14 of the subject embodiment is a fixed displacement pump 32 and the electro-hydraulic fluid flow control mechanism 24 is an electrically controlled bypass valve mechanism 34. The electrically controlled bypass valve mechanism 34 includes a two position valve 36 and an electrically controlled displacement control mechanism 38 associated therewith. An electrical line 40 connects the electrically controlled displacement control mechanism 38 with the electrical controller 22. It is recognized that the fixed displacement pump 32 and the electrically controlled bypass valve mechanism 34 could be replaced with a variable displacement pump and an associated electro-hydraulic pump control mechanism without departing from the essence of the invention.

Each of the first and second hydraulic circuits 16,18 are the same and each includes an actuator 44/45 having first and second fluid ports 46,48. Therefore, the description with respect to the first hydraulic circuit 16 will also describe the second hydraulic circuit 18. The first hydraulic circuit 16 also includes first and second directional valve mechanisms 50,52 and respective first and second electrically controlled displacement control mechanisms 54,56 associated therewith.

A conduit 58 interconnects the fluid conduit 19 from the source of pressurized fluid 14 with the first directional valve mechanism 50 and a conduit 60 interconnects the fluid conduit 19 with the second directional valve mechanism 52.

A one-way check valve 61 is disposed in the conduit 19 upstream of the point of connection of the conduits 58,60 therewith. A conduit 62 connects the first directional valve mechanism 50 to the first fluid port 46 of the first actuator 44 and a conduit 64 connects the second directional valve mechanism 52 to the second fluid port 48 of the first actuator 44. A conduit 66 connects each of the first and second directional valve mechanisms 50,52 to the reservoir 12. A relief and makeup valve arrangement 70 is respectively connected between the conduits 62,64 and the reservoir 12 in a conventional manner.

An electrical line 72 connects the electrical controller 22 to the first electrically controlled displacement control mechanism 54 and an electrical line 74 connects the electrical controller 22 to the second electrically controlled displacement control mechanism 56. The first and second electrically controlled displacement control mechanisms 54,56 operate in cooperation with the respective first and second directional valve mechanisms 50,52 to proportional control fluid flow into and out of the respective first and second fluid ports 46,48 of the first actuator 44 in response to the operator's desired input to the input controller 20.

Each of the first and second directional valve mechanisms 50,52 are movable from a spring biased extreme position at which the source of pressurized fluid is blocked from the respective first and second fluid ports 46,48 and the first and second fluid ports 46,48 are blocked from the reservoir 12 towards a first intermediate position at which the source of pressurized fluid 14 is in open communication with the respective fluid ports 46,48, towards a second intermediate position at which the source of pressurized fluid 14 is blocked from the respective first and second fluid ports 46,48 and the first and second fluid ports 46,48 are blocked from the reservoir 12, and towards a maximum position at which the respective first and second fluid ports 46,48 are blocked from the source of pressurized fluid 14 and in fluid communication with the reservoir 12. The first and second directional valve mechanisms 50,52 are proportionally movable from the spring biased extreme position towards the maximum position in response to an electrical signal that is proportional to the desired input being directed to the appropriate first and second electrically controlled displacement control mechanism 54,56.

Conduits 76,78 respectively connect the first and second directional valve mechanisms 50,52 of the second circuit 18 with the respective first and second fluid ports 46,48 of the second actuator 45. Likewise, electrical lines 80,82 respectively connect the electrical controller 22 to the first and second electrically controlled displacement control mechanisms 54,56 of the second circuit 18.

Figure 2:
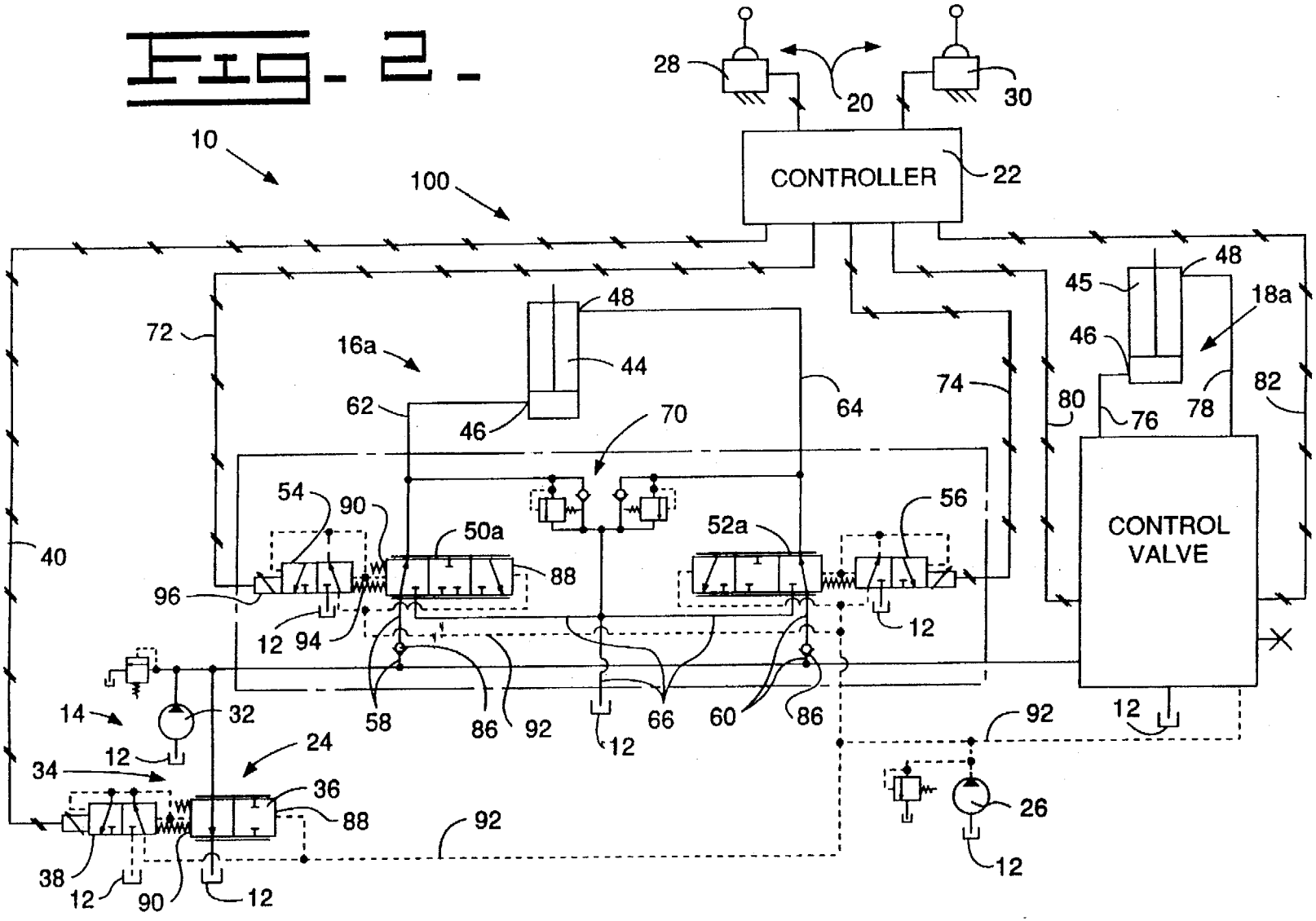
FIG. 2 is a partial diagrammatic and a partial schematic representation of a hydraulic system incorporating another embodiment of the subject invention.

Referring to FIG. 2, another embodiment of the subject invention is illustrated. Like elements have like element numbers. Modified elements are identified by the same element number followed by the letter "a". The first and second directional valve mechanisms **50*a*,52*a* of each of the first and second circuits 16*a* and 18*a* are movable between three positions and include a one-way check valve 86 disposed in the respective conduits 58,60 that interconnects the fluid conduit 19 to the respective first and second directional valve mechanisms 50*a*,52*a*. The one-way check valve 61 of FIG. 1 is not needed in the arrangement of FIG. 2**.

Each of the first and second directional valve mechanisms **50*a*,52*a* is movable from the spring biased extreme position at which the source of pressurized fluid 14 is in communication with the first fluid port 46 of the first actuator 44 towards an intermediate position at which the fluid from the source of pressurized fluid 14 is blocked from the respective first and second fluid ports 46,48 and the first and second fluid ports 46,48 are blocked from the reservoir 12, towards a maximum position at which the respective first and second fluid ports 46,48 are blocked from the source of pressurized fluid 14 and in fluid communication with the reservoir 12**.

As noted above with respect to FIG. 1, the second circuit **18*a* is the same as the first circuit 16*a* and the description of the first circuit 16*a* also describes the second circuit 18*a***.

The first and second directional valve mechanisms **50,52/50*a*,52*a* of both embodiments and the two position valve 36 are each controlled in the same manner by the respective electrically controlled displacement control mechanisms 54,56,38. The description of only the directional valve 50 and its associated electrically controlled displacement control mechanism 54 is described herein. Each of the respective control valves have opposite ends 88,90 that are in continuous communication with the source of pressurized pilot fluid 26 through a supply conduit 92. The electrically controlled displacement control mechanism 54 is disposed in the supply conduit 92 adjacent the end 90 of the directional valve mechanism 50 and a feedback spring 94 is disposed between the electrically controlled displacement control mechanism 54 and the end 90 of the directional valve mechanism 50 which normally biases the directional valve mechanism to its extreme position. A solenoid 96 is disposed on the electrically controlled displacement control mechanism 54 at the end opposite to the feedback spring 94. As shown, the directional valve mechanism 50 is biased to its extreme position with the solenoid 96** de-energized.

The interrelationship of the electro-hydraulic fluid flow control mechanism 24, the input controller 20, the electrical controller 22, and the electrically controlled displacement control mechanisms 54,56 with their associated directional valve mechanisms 50,52 make up a control system 100. Additionally, the interrelationship of the first hydraulic circuit **16/16*a* with the second circuit 18/18*a* also forms part of the control system 100**.

INDUSTRIAL APPLICABILITY

With the hydraulic system 10 shut down, the electro-hydraulic fluid flow control mechanism 34, all of the directional valve mechanisms **50,52/50*a*,52*a* and the two-position valve 36 and all of the electrically controlled displacement control mechanisms 54,56,38 are in the positions illustrated in FIGS. 1 and 2. When the hydraulic system 10 is turned on or started up, the electrical controller 22 checks the electrical system to ensure that there are no electrical malfunctions therein. If no malfunctions are detected, the electrical controller 22 directs an electrical signal of a predetermined magnitude through the electrical lines 72,74,80,82 to the electrically controlled displacement control mechanisms 54,56 of each of the first and second hydraulic circuits 16,18. With respect to FIG. 1, the electrically controlled displacement control mechanisms 54,56 functions to move the respective first and second directional valve mechanisms 50,52 to their second intermediate positions. The first and second directional valve mechanisms 50,52 are moved to their respective intermediate positions in a sequential manner in order to avoid any tendency for the fluid from one end of the actuator 44 to flow to the other end thereof. As the first and second directional control mechanisms 50,52 of each hydraulic circuit 16,18 are being moved to their second intermediate positions, the flow from the source of pressurized fluid 14 is being directed to the reservoir 12 across the two-position valve 36 of the electro-hydraulic fluid flow control mechanism 24. When the operator makes an input to the input controller 28 to operate the first actuator 44, the electrical controller 22 receives the output signal and modifies the electrical control signals being delivered through the respective electrical lines 72,74. If the electrical signal in the electrical lines 72, is being decreased, the first directional valve mechanism 50 moves towards the first intermediate position to progressively connect the source of pressurized fluid 14 to the first fluid port 46 of the first actuator 44 thus moving the actuator 44 in one direction. Simultaneously therewith, an electrical signal of a predetermined magnitude is directed through the electrical line 40 to the electro-hydraulic fluid flow control mechanism 24 to progressively cutoff the flow thereacross from the source of pressurized fluid 14 to the reservoir 12. Additionally, simultaneously therewith, an electrical signal of a predetermined increased magnitude is directed through the electrical line 74 to the second electrically controlled displacement control mechanism 56 to move the second directional valve mechanism 52 towards its maximum position to connect the second fluid port 48 with the reservoir 12. If the load being moved by the actuator 44 is a resisting type of load, the electrical signal through the electrical line 74 may be increased further to move the second directional valve mechanism 52 to its maximum position. However, if the load being moved is an aiding type of load, the magnitude of the electrical signal in the electrical line 74 is controlled thus moving the second directional valve mechanism 52 to a position to meter the flow from the second fluid port 48 to the reservoir 12 and the electrical signal through the electrical line 72 is further decreased to move the first directional valve mechanism 50 to its first intermediate position to permit unrestricted flow from the source of pressurized fluid 14 to the first fluid port 46**.

If the operator desires to reverse the direction of the actuator 44, the desired output from the input controller 28 is directed to the electrical controller 22 which decreases the signal in the electrical line 74 to move the second directional valve mechanism 52 from its second intermediate position towards its first intermediated position to communicate pressurized fluid form the source of pressurized fluid 14 to the second port 48 of the actuator 44. The magnitude of the electrical signal in the electrical line 72 is increased to move the first directional valve mechanism 50 towards its maximum position. The respective signals in the electrical lines 72,74 are controlled in the same manner as set forth above depending on the type of load being moved.

Operation of the second hydraulic circuit 18 is the same as that described above with respect to the first hydraulic circuit 16. It is recognized that both circuits 16,18 could be operational at the same time without departing from the essence of the invention. It is also recognized that if both hydraulic circuits 16,18 are being operated at the same time, it may be necessary to adjust the magnitude of the electrical signal being directed to the electro-hydraulic fluid flow control mechanism 24 to reduce the quantity of flow being bypassed thus ensuring that sufficient flow is available for both of the hydraulic circuits 16,18.

During operation, if a malfunction is detected by the electrical controller 22 in one of the hydraulic circuits 16,18, the controller 22 will momentarily interrupt the electrical signal in the electrical line 40 to the electro-hydraulic fluid flow control mechanism 24 to bypass all of the flow from the source of pressurized fluid 14 to the reservoir 12. Subsequent to bypassing all of the flow, the electrical controller 22 terminates the electrical signals to the one of the hydraulic circuits 16,18 that has malfunctioned thus permitting each of the directional control valve mechanisms 50,52 of that hydraulic circuit to return to its spring biased extreme position. As previously noted, with the first and second directional valve mechanisms 50,52 in their spring biased extreme positions, all ports are blocked. Any attempt of back flow to the source of pressurized fluid 14 or the two-position bypass valve 36 from the other hydraulic circuit is prohibited by the one-way check valve 61.

Once the one hydraulic circuit having the malfunction is shut down, the electrical signal to the electro-hydraulic fluid flow control mechanism 24 can be re-instated and the other hydraulic circuit can continue to operate.

If there is a total electrical failure, all of the flow from the source of pressurized fluid 14 is bypassed to the reservoir 14 across the electro-hydraulic fluid flow control mechanism 24 and each of the directional valve mechanisms 50,52 automatically return to their spring biased extreme positions to block all flow therethrough.

Referring to FIG. 2, the operation thereof is quite similar to the operation described with respect to FIG. 1. However, in FIG. 2, when the hydraulic system 10 is started up, an electrical signal of a predetermined magnitude is directed through the electrical lines 72,74,80,82, to move the respective first and second directional valve mechanisms **50*a*,52*a* of both of the first and second hydraulic circuits 16*a*,18*a* to their respective intermediate positions at which all fluid flow therethrough is blocked. Once all of the directional valve mechanisms 50*a*,52*a* have been moved to their intermediate positions, the electrically controlled bypass valve mechanism 34 once again becomes functional to control the fluid flow thereacross. As described with respect to FIG. 1, any input by an operator to either of the control lever mechanisms 28,30 results in the electrical controller 22 modifying the electrical signals in the respective electrical lines 72,74, 80,82 to move the selected one of the first or second actuator 44,45** in the desired direction.

In the event of an electrical malfunction in one of the hydraulic circuits **16*a*,18*a*, the electrical controller 22 momentarily interrupts the electrical signal to the electro-hydraulic fluid flow control mechanism 24 to bypass the flow from the source of pressurized fluid 14 to the reservoir 12. Simultaneously therewith, the electrical controller 22 terminates the electrical signals to the hydraulic circuit having the malfunction thus permitting each of the first and second directional valve mechanisms 50*a*,52*a* of the malfunctioned hydraulic circuit to return to its spring biased extreme position. Any back flow from the malfunctioned hydraulic circuit is stopped by the one-way check valves 86. The one-way check valves 86 in the unaffected hydraulic circuit also operates to stop any back flow therefrom while the flow from the source of pressurized fluid 14** is being temporarily bypassed.

Once the malfunctioned hydraulic circuit **16*a*/18*a* has been shut down, the electrical signal to the electro-hydraulic fluid flow control mechanism 24 can be re-instated thus once again directing pressurized fluid through the fluid conduit 19 to operate the unaffected hydraulic circuit. The actuator of the malfunction hydraulic circuit cannot move since flow from either end thereof is blocked by the check valves 86**.

In view of the above, it is readily apparent that the subject control system provides a simple arrangement with a limited number of components that allows other hydraulic circuits in a hydraulic system to function even if one or more of the circuits has encountered an electrical malfunction.

Other aspects, objects, and advantages of this invention can be obtained from a study of the drawings, the disclosure, and the appended claims.

What is claimed is:

1. A control system adapted for use in a hydraulic system including a reservoir, a source of pressurized fluid connected to the reservoir, a hydraulic circuit having an actuator with first and second fluid ports, first and second directional valve mechanisms each having at least three positions and being connected between the source of pressurized fluid and the respective ones of the first and second fluid ports of the actuator, and an input controller operative to output an electrical signal to an electrical controller that is proportional to a desired input, the control system comprising:

an electro-hydraulic fluid flow control mechanism associated with the source of pressurized fluid and operative to control the volume of fluid being delivered from the source of pressurized fluid to the actuator;

an electrically controlled displacement control mechanism connected to each of the directional valve mechanisms and operative to move the respective directional valve mechanisms in proportion to receipt of a signal from the electrical controller that is representative of the desired input; and each of the directional valve mechanisms being spring biased to one of its extreme positions in the event of an electrical malfunction in the system.

2. The control system of claim 1 wherein the source of pressurized fluid is a fixed displacement pump and the electro-hydraulic fluid flow control mechanism is an electrically controlled bypass valve mechanism connected to the fixed displacement pump.

3. The control system of claim 2 wherein the electrically controlled bypass valve mechanism includes a two-position valve movable from a first spring biased position at which the flow from the source of pressurized fluid is in communication with the reservoir towards a second position at which the fluid communication with the reservoir is blocked and having an electrically controlled displacement control mechanism associated therewith to move the electrical controlled bypass valve mechanism from the first position towards the second position in response to receipt of an electrical signal from the electrical controller.

4. The control system of claim 3 wherein the hydraulic system includes a second hydraulic circuit having a second actuator with first and second fluid ports, third and fourth directional valve mechanisms each having at least three positions and being connected between the source of pressurized fluid and the respective ones of the first and second fluid ports of the second actuator.

5. The control system of claim 4 wherein the first and second hydraulic circuits are connected in parallel with the source of pressurized fluid by a fluid conduit and the electrical controller is operative to detect an electrical malfunction in either of the first and second hydraulic circuits and de-energize the electrical signals to the respective electrically controlled displacement control mechanisms of the hydraulic circuit having the electrical malfunction thus allowing the respective directional valve mechanisms thereof to be spring biased to their respective extreme positions.

6. The control system of claim 5 wherein each of the first, second, third, and fourth directional valve mechanisms includes a three position valve with a one way check valve disposed between the three position valve and the fluid conduit, each of the three position valves is movable from the extreme position at which pressurized fluid from the source of pressurized fluid is in communication with one of the first and second fluid ports of the respective first and second actuators towards an intermediate position at which fluid flow therethrough is blocked, and towards a maximum position at which flow from the source of pressurized fluid is blocked and the respective one of the first and second ports thereof is in communication with the reservoir.

7. The control system of claim 5 wherein each of the first, second, third, and fourth directional valve mechanisms includes a four position valve, each of the four position valves is movable from the extreme position at which fluid flow between the source of pressurized fluid, the respective actuators, and the reservoir is blocked towards a first intermediate position at which the source of pressurized fluid is connected with the respective one of the first and second ports of the first and second actuator, towards a second intermediate position at which fluid flow between the source of pressurized fluid, the respective actuators, and the reservoir is blocked, and towards a maximum position at which flow from the source of pressurized fluid is blocked and the respective one of the first and second ports thereof is in communication with the reservoir.

8. A method of controlling individual hydraulic circuits in a hydraulic system in the event of an electrical malfunction in one of the hydraulic circuits, the hydraulic system including a reservoir, a source of pressurized fluid connected to the reservoir, an electro-hydraulic fluid flow control mechanism operative to control the flow of fluid from the source of pressurized fluid to the hydraulic circuits in response to an electrical signal, at least two hydraulic circuits each having an actuator with first and second fluid ports, first and second directional valve mechanisms each having at least three positions and being controlled by respective electrically controlled displacement control mechanism and connected between the source of pressurized fluid and the respective ones of the first and second fluid ports of the actuator, and an input controller operative to output an electrical signal to an electrical controller that is proportional to a desired input, the method comprising the steps of:

detecting the electrical malfunction in one of the hydraulic circuits;

de-energizing the electro-hydraulic fluid flow control mechanism and the respective electrically controlled displacement control mechanisms in the one hydraulic circuit to allow the respective first and second directional valve mechanisms to return to their spring biased extreme positions; and re-energizing the electro-hydraulic fluid flow control mechanism in cooperation with the operation of the other functioning circuits.

* * * * *